US005386699A

United States Patent [19]

Myers et al.

[11] Patent Number: 5,386,699

[45] Date of Patent: Feb. 7, 1995

[54] METHOD AND APPARATUS FOR LIQUIFYING NATURAL GAS FOR FUEL FOR VEHICLES AND FUEL TANK FOR USE THEREWITH

[75] Inventors: Albert H. Myers, Port Angeles, Wash.; Raymond E. Tate, Jr., Los Gatos, Calif.; Harold M. Lee, Los Gatos, Calif.; Dragos Sfinteanu, Los Gatos, Calif.

[73] Assignee: American Gas & Technology, Inc., San Jose, Calif.

[21] Appl. No.: 210,155

[22] Filed: Mar. 17, 1994

Related U.S. Application Data

[63] Continuation of Ser. No. 60,269, May 12, 1993, Pat. No. 5,327,730.

[51] Int. Cl.[6] ..... F25J 1/00

[52] U.S. Cl. ..... 62/9; 62/7; 62/36; 123/525; 123/527

[58] Field of Search ..... 62/9, 7, 23, 45.1, 48.1, 62/36; 123/525, 527

[56] References Cited

U.S. PATENT DOCUMENTS

| | | | |
|---|---|---|---|
| 2,103,582 | 12/1937 | Gregory | 62/32 |
| 2,728,406 | 12/1955 | Maher | 62/23 |
| 2,941,374 | 6/1960 | Morrison | 62/23 |
| 3,161,492 | 12/1964 | Keith et al. | 62/23 |
| 3,628,347 | 12/1971 | Puckett et al. | 62/48.1 |
| 3,762,175 | 10/1973 | Jones | 62/48.1 |
| 4,041,721 | 8/1977 | Kniel | 62/53.2 |
| 4,566,885 | 1/1986 | Haak | 62/9 |
| 4,828,591 | 5/1989 | Yan | 62/9 |
| 5,036,671 | 8/1991 | Nelson et al. | 62/23 |

*Primary Examiner*—Ronald C. Capossela
*Attorney, Agent, or Firm*—Flehr, Hohbach, Test, Albritton & Herbert

[57] ABSTRACT

Method for liquifying natural gas comprising regulating the pressure of the natural gas from a pressure ranging from 0–25 psig. Contaminants are filtered out of the regulated natural gas. The natural gas is then compressed to a higher pressure. At least a one-stage heat exchange is performed with the compressed natural gas by utilizing a coolant to provide a cooled compressed natural gas. A Joule Thompson valve is used to liquify at least a portion of the cooled compressed natural gas. The liquified natural gas is stored in a dewar. Unliquified natural gas passing from the dewar is utilized to provide cooling of the natural gas during the heat exchange. The unliquified natural gas is then recompressed. The recompressed natural gas is subjected to the same steps to liquify an additional portion of the recompressed natural gas.

6 Claims, 5 Drawing Sheets

METHOD AND APPARATUS FOR LIQUIFYING NATURAL GAS FOR FUEL FOR VEHICLES AND FUEL TANK FOR USE THEREWITH

This is a continuation of application Ser. No. 08/060,269 filed May 12, 1993 now U.S. Pat. No. 5,327,730.

This invention relates to a method and apparatus for liquifying natural gas for fuel for vehicles.

Natural gas has been used as a fuel for vehicles in compressed and liquified forms. The use of compressed natural gas has limitations. The storage capacity of high pressure cylinders limits vehicle travel before a refill. Filling high pressure cylinders is a time consuming process because the heat of compression must be dissipated when completely filling the cylinder or tank. Liquified natural gas requires a source of liquid. Natural gas in liquid form is typically created by a colder liquid such as nitrogen or by the use of a Joule Thompson expansion engine. Such processes typically have been utilized in large plants or facilities. Such installations are not that particularly adapted for small filling stations. There is therefore need for a new and improved method and apparatus for supplying natural gas for fuel for vehicles.

In general, it is an object of the present invention to provide a method and apparatus for liquifying natural gas for fuel for vehicles utilizing a Joule Thompson expansion.

Another object of the invention is to provide a method and apparatus of the above character which can be used for liquifying natural gas from a local natural gas distribution line.

Another object of the invention is to provide a method and apparatus of the above character which can be utilized with natural gas taken directly from natural gas wells.

Another object of the invention is to provide a method and apparatus of the above character which is particularly useful in connection with motor vehicles such as cars, buses, trucks and the like.

Another object of the invention is to provide a method and apparatus of the above character which is particularly useful in connection with filling stations.

Another object of the invention is to provide a method and apparatus of the above character which is of a size that is portable.

Another object of the invention is to provide a method and apparatus of the above character in which a blended gas is utilized which includes a refrigerant carrier gas having a liquifying temperature which is less than that of the other natural gas.

Another object of the invention is to provide a method and apparatus of the above character in which the refrigerant carrier gas is nitrogen.

Another object of the invention is to provide a method and apparatus of the above character which has an increased yield.

Another object of the invention is to provide a method and apparatus of the above character in which stations can be provided for fueling vehicles with either liquid natural gas or compressed natural gas.

Another object of the invention is to provide a method and apparatus of the above character in which the apparatus includes a vessel or tank which can be mounted in an automobile for using liquified natural gas.

Another object of the invention is to provide a method and apparatus of the above character which can be used to prevent boil off of liquid natural gas and other cryogens (e.g. nitrogen) at storage facilities whether mobile or stationary.

Another object of the invention is to provide a method and apparatus of the above character which can be used at well heads to separate out higher hydrocarbons such as ethane, propane, butane, pentane, hexane and nitrogen.

Additional objects and features of the invention will appear from the following description in which the preferred embodiments are set forth in detail in conjunction with accompanying drawings.

Figure 1:
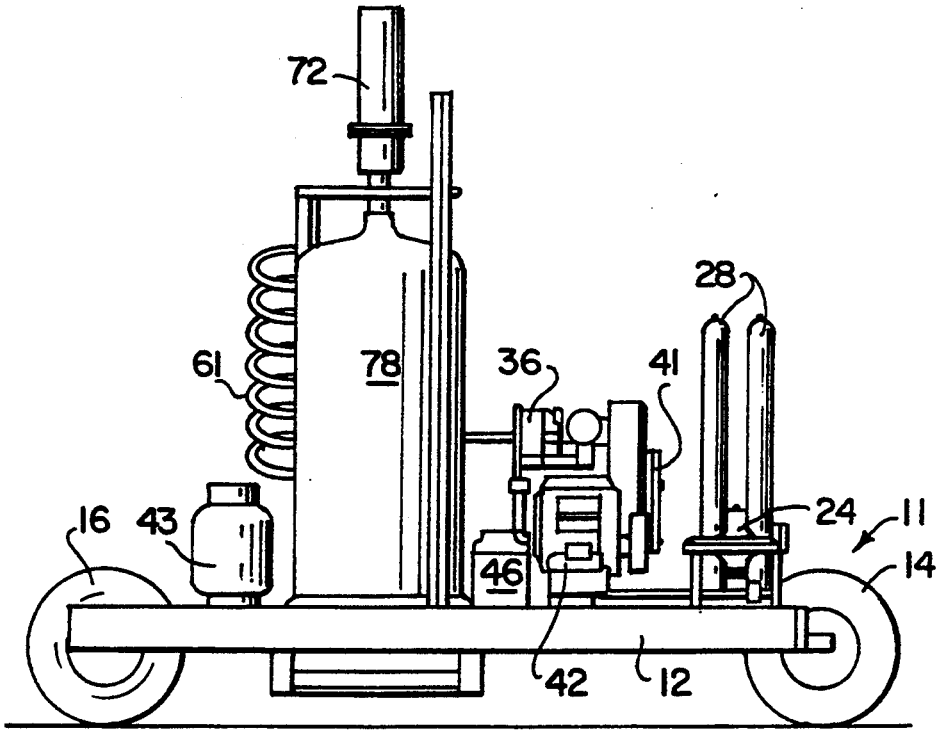
FIG. 1 is a side elevational view of a portable apparatus incorporating the present invention for liquifying natural gas for fuel for vehicles.
Figure 2:
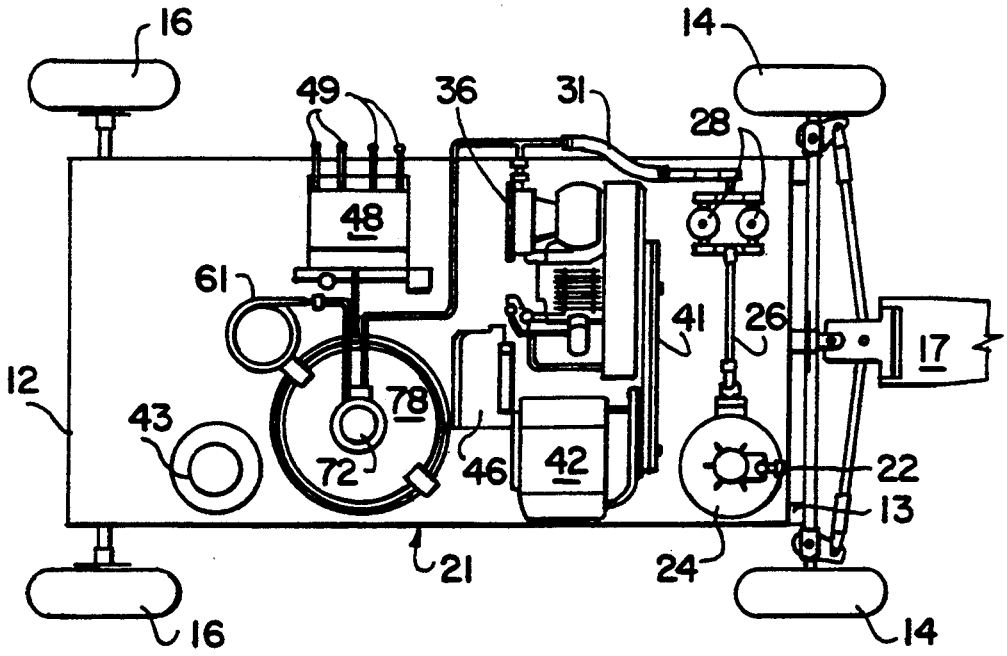
FIG. 2 is a top plan view of the apparatus shown in FIG. 1.

More in particular, the method and apparatus of the present invention for supplying natural gas for use in motor vehicles is shown in FIGS. 1 and 2. As shown therein, it consists of a wheeled platform in the form of a trailer 11 which is provided with a flat bed 12 carried by a framework 13. Front and rear wheels 14 and 16, respectively are provided for supporting the framework. A trailer hitch 17 is provided and is secured to the framework 13.

The apparatus 21 for liquifying natural gas for use on vehicles is mounted on the bed 12 and consists of a natural gas inlet 22 connected through a shut off valve 23 (FIG. 4) to a regulator 24. The natural gas normally ranges in pressures from 40 to 70 pounds per square inch gauge (psig) and typically about 60 psig. The regulator 24 supplies gas through piping 26 (FIG. 2) at a suitable pressure, as for example 0–25 psig and typically 0–1 psig through a flow meter 27 (FIG. 4) to a pair of primary filters 28 connected in parallel as shown. The primary filters 28 are utilized for removing undesired contaminants such as sulfur, water, free oil in the form of globules of oil and particulates. A filter 28 incorporating the present invention which is particularly efficacious is one supplied by Pall. The present application is used for filtration and gettering. Material utilized for this purpose can be in the form of solid pellets having a diameter of about 1/32 of an inch and a length of approximately 3 millimeters which has been designed to remove water and $CO_2$. Placing this material in the stainless steel Pall filter housing serves to remove particles down to 0.1 microns. Typically the pellets can be poured into the filter to completely fill the outer portion of the filter housing. In such an arrangement, the gas to be processed comes from outside of the housing and enters the inner core of the filter housing and then goes downstream. Gas traveling through these pellets ends up on the interior of the filter housing as a particulate-free water free gas that is supplied to the compressor 36.

Filter 28 can also include a molecular sieve and getter for moving other undesired contaminants. After passing through the primary filter 28, the low pressure gas is supplied through piping 31 to a multistage, as for example a five-stage, mechanical type compressor 36 with an oil free last stage and which is particularly adapted for utilizing a feed stock such as methane to provide an output pressure ranging from 600–5000 psig and preferably a pressure of approximately 2500–3000. The compressor 36 can be of a suitable type such as Model IKC180 supplied by Bauer Compressors, Inc., 1328 Azalea Garden Road, Norfolk, Va. 23502. It is comprised of five stages in which the first four stages are provided with pistons having oil rings thereon whereas the fifth stage is a piston with solid carbon rings so that its last stage is oil free. It has a capacity of 8–23 cubic feet per minute or 200–650 liters per minute. It is capable of producing gas under pressure from 3000–7000 psig at 210–500 bar.

The compressor 36 is driven by belts 41 which are driven by a gas engine 42 of a conventional type. Typically, as hereinafter described, the engine 42 is operated from undesired gases removed from the natural gas, as for example propane. A storage for propane or other hydrocarbons could be provided in a bottle or tank 43 mounted on the platform 11. A battery 46 is provided for starting and operating the engine 42.

The output from the compressor 36 is supplied to a line 51 (see FIG. 4) which is connected to a pressure regulator 52 which regulates the pressure within the desired range, as for example 2500 to 3000 psig. The output of the regulator 52 is supplied to an oil and water separator 53 and then it passes through a final filter 54.

The pressurized natural gas is then supplied to a primary heat exchanger 56 which may be of the countercurrent type in which a coolant is used. By way of example, such a heat exchanger 56 could consist of an outer pipe and an inner pipe in which the outer pipe has an outside diameter of ½ inch and the inner pipe has a diameter of ¼ inch in which the compressed gas flows through the inner pipe. A coolant gas flows in the annular space between the inner and outer pipes. The outer pipe is insulated. Cooling for the countercurrent primary heat exchanger 56 is obtained from a suitable source, as for example a source of cooled carbon dioxide or nitrogen stored in a dewar 61. The coolant travels from the dewar 61 through a valve 62 to the countercurrent heat exchanger 56 to provide a coolant in the space between the inner and outer walls of the heat exchanger and then discharged to ambient at the outlet 63.

Figure 4:
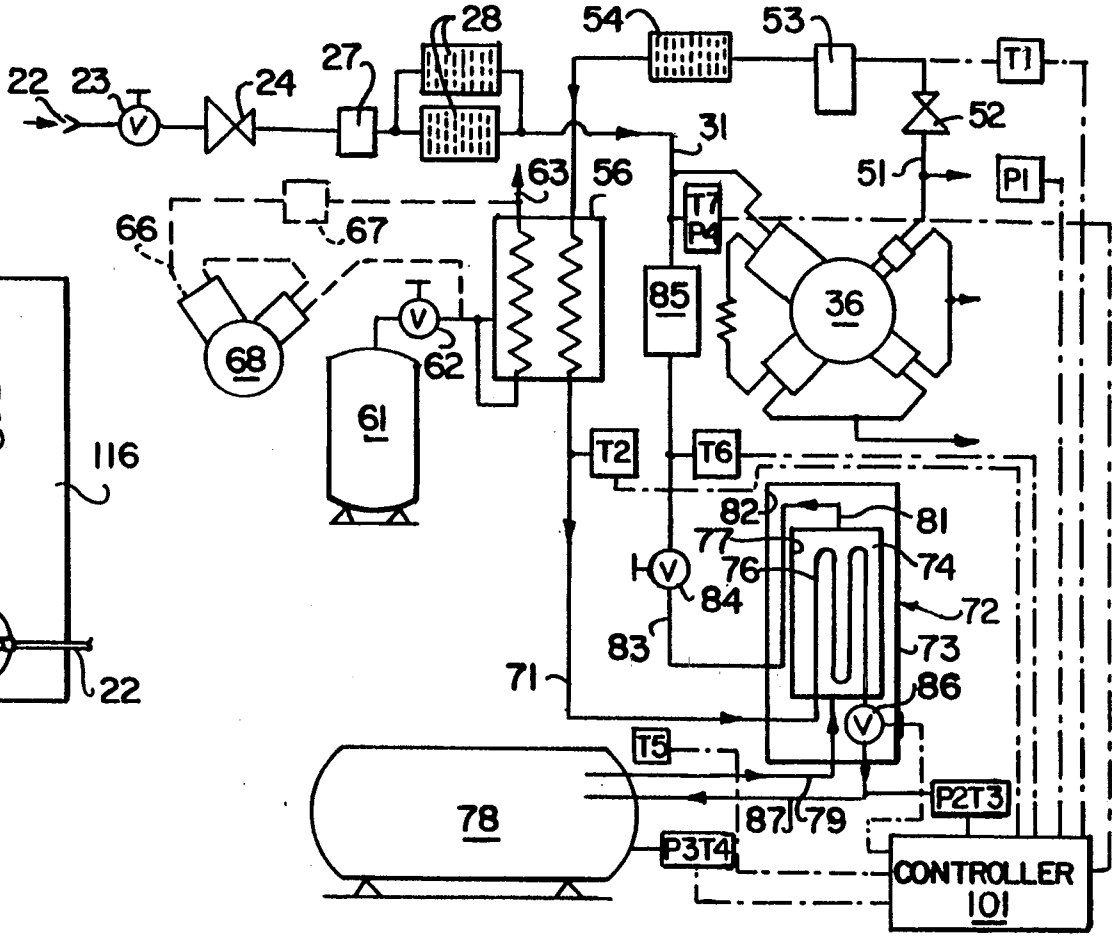
FIG. 4 is a schematic flow diagram showing the method natural gas liquified in accordance with the present invention with apparatus of the type shown in FIGS. 1–4.

Another alternative for providing such preliminary cooling for the countercurrent heat exchanger 56 can be obtained by utilizing propane provided in propane loop 66 which is shown in the dotted lines in FIG. 4. It consists of an ejector 67 and a propane compressor 68 which supplies compressed propane to the inlet of the heat exchanger 56 to create the desired cooling.

The compressed natural gas passes from the primary heat exchanger 56 after being cooled to a suitable temperature, as for example a −40° F. is supplied to the inlet of a main heat exchanger 72. The main heat exchanger 72 consists of an outer cylinder 73 and with an inner cylinder 74 concentrically disposed within the outer cylinder 73. A convoluted finned tube 76 is provided within the inner cylinder 74 is shown in FIG. 4. The interior space 77 within the inner cylinder 74 is in communication with the interior of a large dewar 78 through piping 79. The interior space 77 is also in communication with outlet piping 81 that extends through an evacuated space 82 provided between the inner cylinder 74 and the outer cylinder 73.

The other end of the tube 76 is connected through a Joule Thompson expansion valve 86 disposed in the evacuated space and is connected by piping 87 which extends into the dewar 78. This main heat exchanger 72 is utilized for bringing the temperature of the natural gas down to a −120° F. to −140° F. for subsequent liquifying. Piping 83 of a suitable size, as for example one inch pipe supplies gas under low pressure through a valve 84 and a warm up device 85 to the compressor 36.

The compressed gas going through the countercurrent heat exchanger 72 is a gas to be cooled down from approximately −10° F. to −140° F. at 2500 lbs. per square inch gauge. At this point in the heat exchanger, the gas is closer to liquification. By expanding it down to approximately atmospheric pressure through a critical orifice in the Joule Thompson valve 86 a phase change occurs from a gaseous phase to a liquid phase at a temperature near −260° F. The liquid natural gas (LNG) drains by gravity into the dewar 78. Unliquified natural gas returns through the line 79 from the dewar 78 and through the space 77 to cool the incoming natural gas coming into the countercurrent heat exchanger 72. The cooled gas which is discharged from the heat exchanger 72 is supplied through the piping 83 back to the compressor 36 where it is recycled so that additional natural gas will be liquified during the next cycle.

Figure 3:
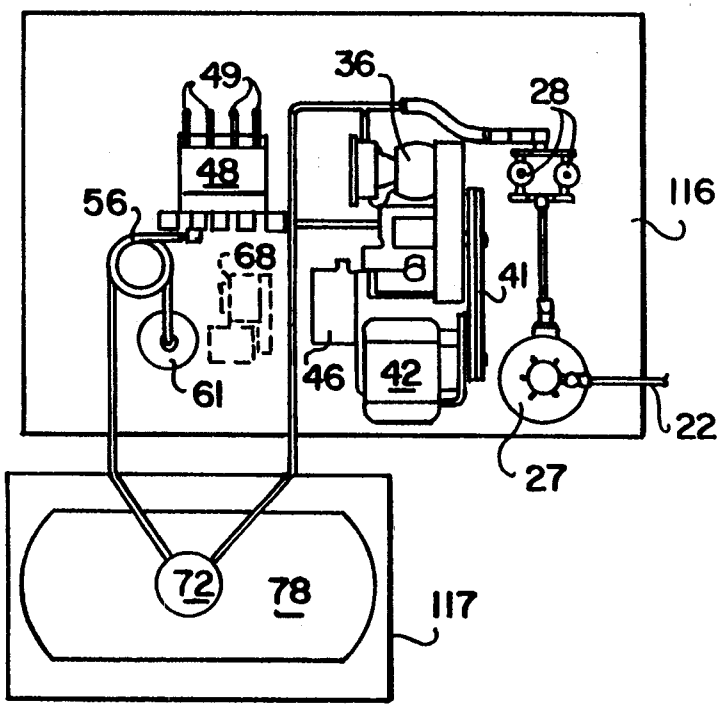
FIG. 3 is a top plan view of a stationary plant of an apparatus for liquifying natural gas for fuel for vehicles.

Another embodiment of the apparatus and system incorporating the present invention is shown in FIG. 3 in which in place of a wheeled platform or trailer 11 the apparatus and system is mounted on two pads 116 and 117, as for example concrete pads. As shown in FIG. 4, most of the apparatus is provided on the pad 116 whereas the dewar 78 with the main heat exchanger 72 positioned thereabove is mounted on and is carried by the pad 117 off to one side of the pad 116.

From the foregoing it can be seen with the method of the present invention, two stage cooling is provided with the first stage of cooling being provided by the primary heat exchanger 56 and with the second stage of cooling being provided by the main heat exchanger 72. The gas after the second stage of cooling is expanded through the valve 86 down to atmospheric pressure to liquify a certain percentage of the gas stream, as for example a percentage ranging from 15–50% preferably between approximately 30 and 40%. The natural gas that is not liquified comes back out of the dewar 78 and is used for cooling in the final heat exchanger 72 through the warm up coil 85 to bring the natural gas to a temperature of approximately 40° F. so that it can be reintroduced back into the compressor 36.

The expansion valve 86 is located immediately above the dewar 78 which makes it possible to control the amount of expansion based upon the density that is produced by the cooling of the liquid. The valve 86 is provided with a variable orifice to optimize efficiency which makes it possible to control the amount of expansion based upon the density of the liquid that is produced by cooling of the gas. In comparison to liquifying a gas of a known composition, as for example air which has 21% oxygen and approximately 79% nitrogen it is possible to provide a single orifice. With natural gas the constituents may vary. Therefore it is important to have a variable orifice valve so that the expansion is proportional to the density of the liquids which are formed from the gas. In order to obtain optimum liquification it is desirable to know the constituents in the gas so that the orifice can be adjusted appropriately. In connection with the present invention, it is typically desirable to provide a pure methane. Methane can be readily separated because it liquifies at a different temperature from the other constituents of natural gas.

Converting the natural gas to a liquid consumes approximately 330 BTUs per pound which must be removed from the gas to change it from a gas to a liquid. With the removal of this much energy, a yield of approximately 30% in liquifying of gases can be obtained. These other constituents such as propane and butane can be used as a fuel and can be carried off by piping and burned or utilized for other purposes. For example, as hereinbefore described, the propane or butane can be utilized for running the engine 42 for the compressor 36. Contaminants in the natural gas, as for example water and $CO_2$ which are not usable as a fuel may be filtered out and separated. It is important to remove water because it can freeze and block orifices and shut down the system.

In connection with the present apparatus, it is possible to provide an apparatus which is relatively compact and portable so that it can be made small enough to fit into a homeowner's garage.

In order to operate the apparatus to perform the present method, it is desirable that pressures and temperatures be monitored in the apparatus and the system to obtain optimum efficiency by automatically controlling the opening and closing of the expansion valve 86 in accordance with the measured temperatures and pressures. This can be readily accomplished by a controller 101 accepting the information from the transducers and supplying information to a stepper motor (not shown) which can be used for operating the expansion valve 86 to control the variable orifice.

Since the compressor 36 is a five stage compressor, and each outlet at each stage is available, the gas which liquifies at a lower temperature can be drained off by operation of one of the valves 49 of the control console 48. As explained previously one or more of these gases can be utilized for operating the engine 42 for driving the compressor 36.

Figure 5:
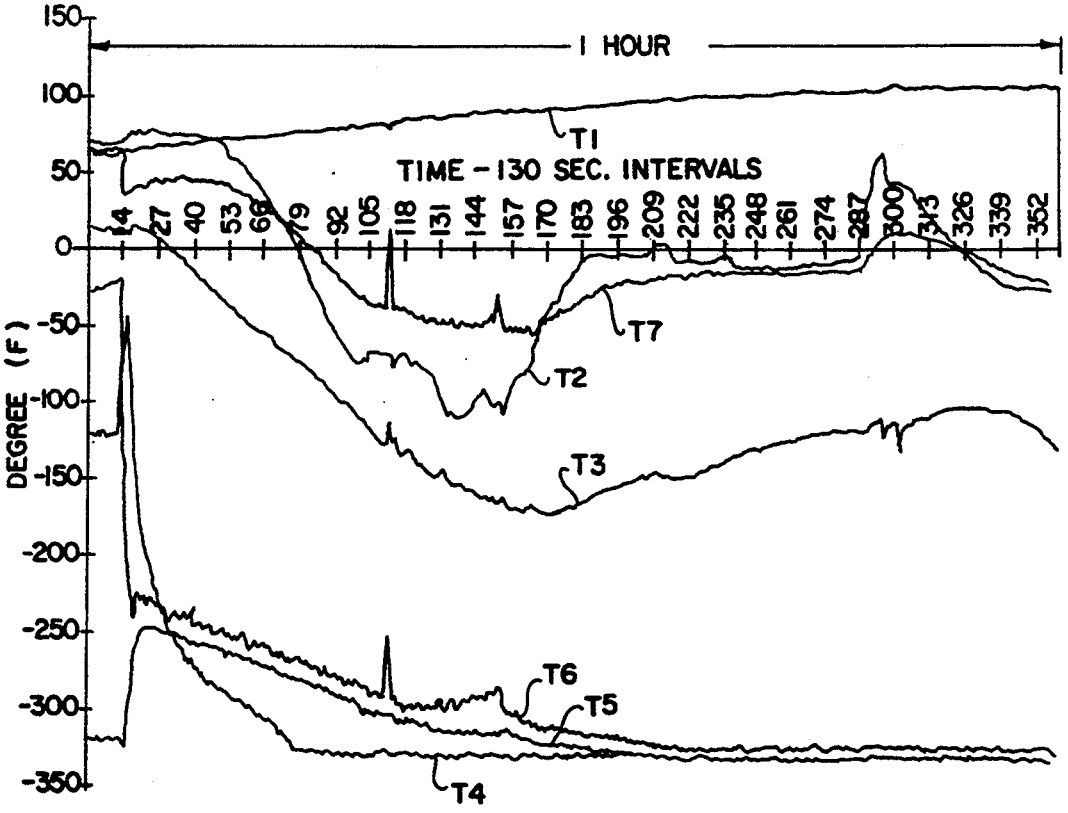
FIG. 5 is a graph showing the temperature changes with time utilizing the method of the present invention for liquifying natural gas.

In FIG. 5, there is a graph showing the measurement of the temperatures T1–T7 in the apparatus of the present invention at one hundred thirty second intervals using nitrogen rather than natural gas. FIG. 5 shows the operation of the apparatus and system for approximately 3600 seconds which is equal to one hour. In operation of the apparatus, and in particular, operation of the five-stage compressor 36 at each stage of compression, entropy is increased. Such compression brings about a higher, temperature called the heat of compression. This heat of compression is heat exchanged away. The gas is then compressed and heat exchanged away until this has been accomplished five times in the five-stage compressor. To produce the pressure of 3500 psig which is reduced by the regulator 52 to 2500 psig after which it is cooled in the primary heat exchanger 56 and the main heat exchanger 72 as hereinbefore described. This cooling is shown in FIG. 5 in which it is shown that at a temperature −320° F. liquification of nitrogen commences as shown by the curve T6 in FIG. 5. From FIG. 5 it can be seen that all three of the temperatures T4, T5 and T6 went well below 320° F. which ensures that the nitrogen is being liquified and also ensures that the apparatus and method can be utilized for liquifying methane which liquifies at a higher temperature, as for example 259° F. Thus it can be seen that liquification was occurring during substantially all of the 3600 seconds of the one hour run.

Figure 6:
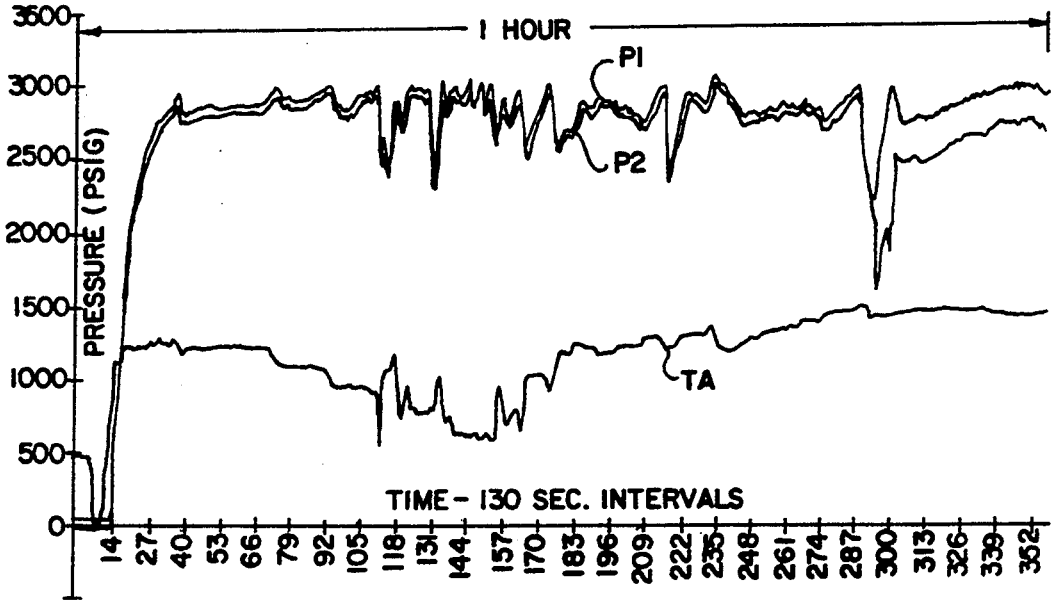
FIG. 6 is a graph showing the pressure in pounds per square inch gauge utilized in the method of the present invention for liquifying natural gas.

FIG. 6 shows the corresponding pressure curves for the same run which is shown in FIG. 5 in which the curve TA represents the RPM of the compressor 36 and pressure curves P1 and P2 show how they track with the RPM of the compressor. Pressures P1 and P2 should be very close to each other with the difference between the same to be represented by line losses depending upon the flow of gas. From FIG. 6 it can be seen that at 2,870 seconds into the run, P1 and P2 separated from each other because some water leaked into the system. This caused the main heat exchanger to ice up and partially close off a pipe leading therethrough. Thus, it can be seen by watching the pressures P1 and P2, the operation of the heat exchangers can be observed.

Figure 7:
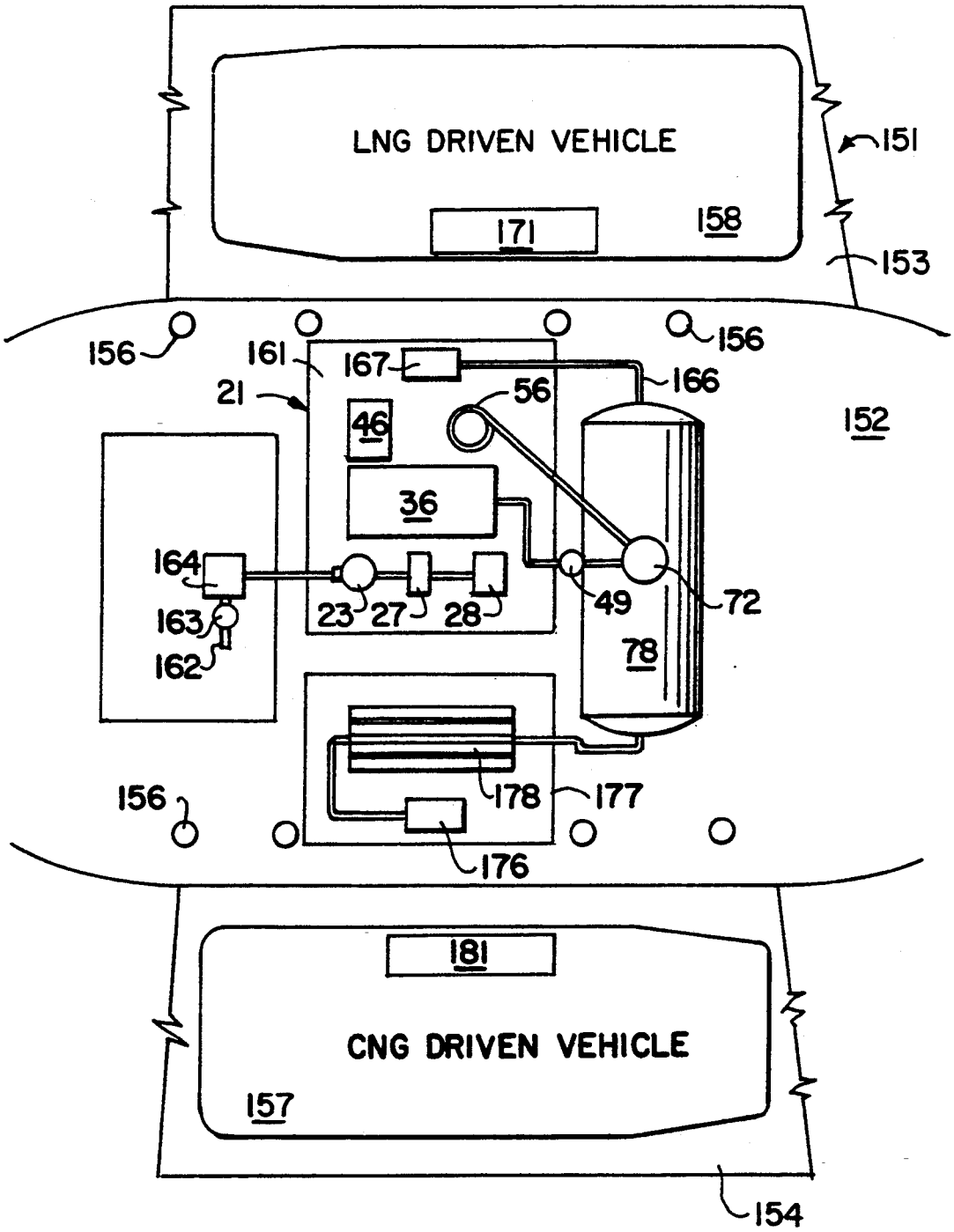
FIG. 7 is a top plan view of a filling station incorporating the apparatus of the present invention which can be utilized for fueling vehicles with either compressed natural gas or liquified natural gas.

Although the liquifying apparatus 21 has been shown in FIG. 1 as being mounted on a wheeled platform it should be appreciated that it can be mounted on a skid-mounted platform and can be moved from one location to another, as for example by the use of a forklift. A skid-mounted platform may be comprised of steel box channels extending longitudinally of the platform with steel flat stock mounted on the box channels to provide a surface area which is large enough to accommodate the liquifying apparatus 21. Thus, as shown in FIG. 7 there is provided a landscaped island 152 which is generally oval shaped and which is provided with driveways 153 and 154 disposed on opposite sides of the island through which motor vehicles such as cars, buses and trucks can pass and still be in close proximity to the island so that they can be serviced by the island. Protective posts 156 are provided on opposite sides of the island 152 to prevent the vehicles 157 and 158 utilizing the driveways 153 and 154 striking equipment which is provided within the island.

The liquifying apparatus 21 is mounted on a pad 161 in the island 152 and can be supplied with natural gas from a pipeline 162 which is connected through a turn-off valve 163 to a natural gas meter 164 connected to the input regulator 23 as shown in FIG. 7. The dewar 78 of the liquifying apparatus 21 is connected to a station console 167 mounted on the pad 161. The console 167 is provided with the appropriate flexible hoses for supplying liquid natural gas to a vehicle such as vehicle 158 which is provided with a liquid gas tank 171.

The island 152 is also provided with the filling station console 176 which can supply compressed natural gas. This console is mounted on a pad 177 provided in the island and supplied with a natural gas star vaporizer 178 which takes liquid natural gas supplied from the dewar 78 through piping 179. The star vaporizer 178 is of a conventional type and is provided with fins which are utilized for transferring heat from the ambient atmosphere to the center core of the vaporizer to provide a more efficient heat transfer to cause vaporization of the cold vapor or liquified gas supplied by the piping 179. The filling station console 176 is provided with suitable equipment, including hoses (not shown) for supplying the compressed natural gas to a tank 81 of the compressed natural gas driven vehicle 157.

It is desirable to provide the compressed natural gas in this matter because the compressed natural gas is still quite cool and can be utilized to fill up the tank 181 without having to wait to have the compressed natural gas cool down as when it is supplied directly from a compressor to the tank 181. By using the liquifying apparatus 21, it is possible to store much larger quantities of natural gas by liquifying the same and providing it in the dewar 78 rather than providing the gas in tanks which normally would be larger in size and require a greater area for placement of the compressed natural gas tanks.

In accordance with the method of the present invention it has been found that it is possible to substantially increase the efficiency of the liquifying apparatus 21 thus then rather than running substantially puromethane through the apparatus and system and liquifying the methane, it has been found that improved efficiency in liquifying methane can be achieved by running with the methane gas a carrier gas refrigerant. For the carrier gas refrigerant it is desirable to choose a gas which liquifies at a temperature slightly below, as for example 10° F. that of the gas which is to be liquified. Thus, since methane liquifies at a temperature of approximately −260° F., it is desirable to utilize a carrier refrigerant gas which liquifies at a temperature of −270° F. or less. Since nitrogen liquifies at a temperature substantially below −260° F., as for example −320° F. and is relatively inexpensive, it is particular suitable for use in the process of the present invention. It is thus after the liquification process hereinbefore described as been started for liquifying methane, the carrier refrigerant gas can be introduced into and mixed with the methane gas, as for example introducing it into the compressor 36 at the input line 191 shown in FIG. 4. Nitrogen is continued to be bleed into the system until the efficiency of increased liquifying out of methane has been optimized. After this optimum point has been reached, no further nitrogen is introduced into the system. The nitrogen will stay in the system and will remain a part of the gaseous system in the liquifying apparatus 21. The nitrogen operating in the system will always remain in the gaseous phase because the temperature in the system never gets below the −320° F. when the system is utilized for liquifying a natural gas such as methane. In addition, when liquifying methane, it is not desirable to decrease the temperature below −290° F. because at this temperature, the liquid methane becomes a solid. Thus, in accordance with the method of the present invention, it is preferable to operate the system so that the gas exits from the Joule Thompson valve 86 is at approximately −260° F. the liquifying temperature for methane.

It should be appreciated in accordance with the present invention when utilizing the carrier refrigerant, it is possible to eliminate by one of the heat exchangers, as for example the primary heat exchanger 56. Even without a carrier refrigerant, it has been found that it possible to liquify approximately 30% of the methane gas whereas utilizing a carrier refrigerant such as nitrogen, it is possible to improve the yield to at least 50% or more liquification of natural gas during each pass of the natural gas through the system.

Thus it can be seen with the method of the present invention, it is possible to liquify one gas by utilizing a carrier refrigerant gas having a liquifying temperature which is less than that of the gas being liquified. In other words, it can be said that the carrier refrigerant serves to knock out or eliminate or in other words liquify the gases which have a higher liquifying temperature.

In accordance with the present invention it is believed that increased efficiency is achieved by the use of a carrier refrigerant gas because as the carrier refrigerant gas expands in the Joule Thompson valve it drops the temperature at a greater temperature differential than the gas having the higher liquifying temperature.

Also when a carrier refrigerant gas is utilized, the carrier refrigerant gas will boil off in the dewar and will come back across the counter-current heat exchanger to cool the incoming warmer gas or gases to provide an improved cooling or that which would be provided if methane were being utilized alone in the system. Thus a methane entering the Joule Thompson valve 86 will be much cooler when cooled with gaseous nitrogen rather than gaseous methane. By way of example, if 70% of the gas being supplied to the heat exchanger 72 is returned back to the compressor 36 when utilizing a mixture of 70% nitrogen and 30% methane, all the methane would be liquified and the returning gas would be nitrogen which typically would be at a lower temperature than that of the gaseous methane. However, since it is desirable to obtain at least approximately 50% liquification of methane in each pass of methane through the cycle, it is desirable that the nitrogen gas constitutes slightly less than 50% of the total mixture by volume to obtain optimum efficiency of liquification of methane.

Although the method and apparatus of the present invention has been directed particularly to the liquifying of the natural gas, it should be appreciated that the methane apparatus has other applications, for example it can be utilized for liquifying gases other than natural gas utilizing the same principles and apparatus. For example, as shown in certain of the charts, nitrogen can be readily liquified with the method and apparatus. The apparatus also can be utilized to prevent the boil off of liquid natural gas and other cryogens including nitrogen at storage facilities whether they be stationary or mobile. The method and apparatus can also be used at well heads to separate out higher hydrocarbons such as ethane, propane, butane, pentane, hexane and nitrogen.

In utilizing liquid natural gas in liquid natural gas driven vehicles such as a vehicle 158 it has been found that when the power requirement for the vehicle increases, as for example when climbing hills or carrying heavy loads, that the liquid natural gas in the tank 171 will not vaporize rapidly enough and this will cause starving of the engine and a consequent loss of power. To overcome this problem in the past a cryogenic pump has been installed outside of the tank and has been utilized to provide a constant pressure of vaporized natural gas to the engine. However, such cryogenic pumps are expensive and also consume large amounts of power. To solve this problem in connection with the present invention, means has been provided for heating the liquid natural gas within the tank to provide the desired amount of vapor pressure within the tank so that a substantially constant pressure of natural gas vapor is delivered to the engine for the vehicle 158.

Figure 8:
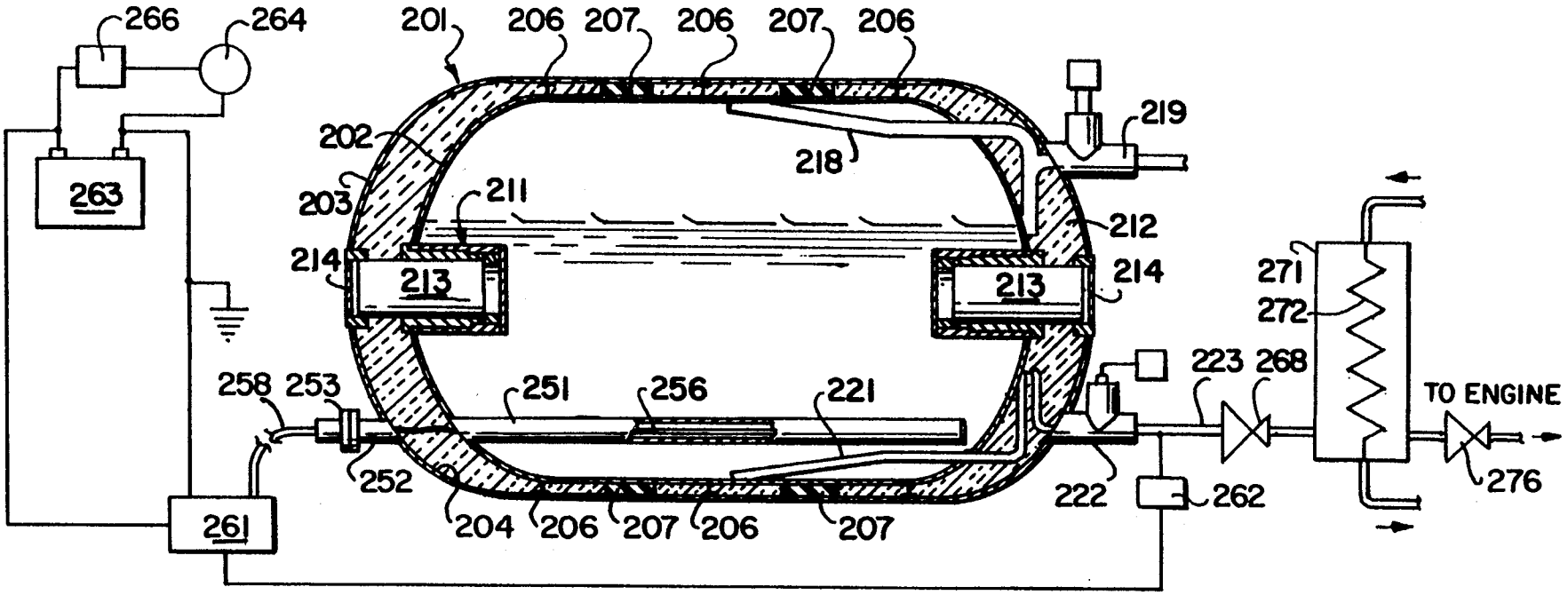
FIG. 8 is a cross-sectional view of a tank which can be mounted on a motorized vehicle for carrying a liquified natural gas and dispensing the same therefrom for use in the motor vehicle.

A tank provided with such heating means is shown in FIG. 8. The tank 201 consists of an inner vessel 202 and an outer vessel 203 which encloses the inner vessel 202 and provides an evacuated space 204 surrounding the inner vessel 202. The vessels 202 and 203 are formed of a suitable material such as stainless steel. The inner vessel 202 is supported in the outer vessel 203 in a spaced apart position by a plurality of longitudinally spaced apart struts 206 formed of a suitable insulating material such as plastic. A plurality of layers of insulation 207 are provided between the walls of the vessels 202 and 203 and within the space 204. For example, as many as fifteen layers of fiberglass paper and/or Pearlite insulation can be provided in this space. The vessels 202 and 203 are provided with support assemblies 211 and 212 which accommodate expansion and contraction along the longitudinal axis of the inner vessel 202 with respect to the outer vessel 203 and to prevent rotation of the inner vessel 202 with respect to the outer vessel 203. The support assemblies 211 and 212 include a tube 213 formed of a suitable insulating material such as fiberglass which is connected by Belleville washers 214 to collars 216 on the outer vessel 203.

An inlet and outlet pipe 218 is mounted in the upper part of the inner vessel 202 for gas in the gaseous phase in the tank and is connected to a shut off valve 219. Another inlet and outlet pipe 221 is provided in the bottom part of the inner vessel 202 for access to liquified gas in the vessel and is connected to a shut off valve 222. The shut off valve 222 is connected to a pipe 223.

A heater well 251 is provided within the inner tank 202 and extends longitudinally thereof and is spaced a short distance above the bottom wall of the inner vessel 202. As shown, the heater well 251 can extend substantially the entire length of inner vessel 202 and can be spaced a suitable distance, as for example ½ inch to approximately 4 inches above the bottom wall of the vessel 202. The heater well 251 can be formed of a suitable material such as stainless steel and has one end closed with the other end being open to the vacuum in the evacuated space 204. A fitting 152 in alignment with the heater well 251 is mounted on the outer vessel 203 and is provided with a conventional vacuum type flange 253. The heater well 251 can be of a relatively small size, as for example the inner diameter can range from ¼ inch to ½ inch and can contain therein filaments 256 formed of a suitable material such as Nichrome which are connected to an electrical fitting 257 secured to the flange 253 and connected by a cable 258 to a suitable power supply, as for example a 12-volt battery supply of a motor vehicle as hereinafter described.

The energy supplied to the heater filaments 256 is controlled by a controller 261 which in its simplest form can be in the form of an on/off switch. Controller 261 is controlled by a pressure sensor 262 which is connected into the supply line 223. The controller 261 receives its power from a conventional 12-volt vehicle battery 263 maintained in a charged condition by a generator 264 through a regulator 266. Typically it may be desired to maintain a pressure of 15 to 125 psig within the vessel 202. This pressure is then regulated down to the desired pressure by a regulator 268 for use in the vehicle, as for example 30 to 40 psig. Since the vaporized natural gas will still be very cold, as for example in the vicinity of −150° F. it is desirable to heat this gas before it is supplied to the engine. Typically this can be readily accomplished by supplying the same through a heat exchanger 271 which is provided with a coil 272 through which hot water, as for example hot water from the radiator of the vehicle can be utilized for heating the natural gas to a suitable temperature, as for example 20°–70° F. and preferably a temperature of approximately 60° F. before it is supplied to the vehicle engine. The heated natural gas can be regulated to a desired pressure by a regulator 276, as for example to 0–1 psig and then supplied to the fuel injection system or carburetor for the engine.

It is apparent from the foregoing that there has been provided a method and apparatus for liquifying natural gas for fuel for use in vehicles which is advantageous in that it makes it possible to provide relatively economical small and medium sized filling stations for supplying liquified as well as compressed natural gas for use as fuels in vehicles. The smaller size filling stations can be made of a size so that they can be readily transported from one location to another, as for example, by placing the entire station on skids or by placing the same on a trailer. By liquifying the natural gas at the filling station it is possible to provide a relatively compact filling station while still providing the capability of supplying either liquified natural gas or compressed natural gas for use in the motor vehicles. By utilizing two-stage cooling in connection with a Joule Thompson valve in conjunction with the present method, it is possible to provide a relatively efficient process which is suitable for use in small and medium sized filling stations.

By adding a nonfuel-type gas to the natural gas during the process, the efficiency of the process is increased substantially by utilizing a nonfuel gas, as for example nitrogen for cooling in the process. By providing a tank for the liquid natural gas in the vehicle with heating means within the tank, it is possible to maintain a substantially constant vapor pressure for supplying vaporized natural gas to the vehicle so that the vehicle can operate normally even under increased power requirements, as for example when climbing steep hills.

What is claimed is:

1. A tank for use on a vehicle driven by liquid natural gas, comprising an outer vessel, an inner vessel disposed within the outer vessel, support means disposed within the outer vessel and for supporting the inner vessel within the outer vessel so that the wall of the inner vessel is spaced apart from the wall of the outer vessel and to provide a space therebetween, means for evacuating the space between the outer vessel and the inner vessel, the inner vessel having a bottom wall, a heater well disposed in the inner vessel in close proximity to the bottom wall of the inner vessel and being surrounded by liquid natural gas, said heater well being accessible through the outer vessel, a removable heating element disposed in the heater well and means for supplying electrical energy to the heater element in the heating well to maintain a substantially constant vapor pressure in the inner vessel so that a vapor of natural gas can be supplied to the engine of the motor vehicle at a substantially constant pressure regardless of the requirements of the engine of the vehicle.

2. A tank as in claim 1 together with means for heating the natural gas vapor after it leaves the inner vessel.

3. A tank as in claim 1 together with means for regulating the pressure of the natural gas vapor after it has been heated.

4. A tank as in claim 1 wherein said inner tank is in the form of a horizontally disposed cylinder.

5. A motorized vehicle comprising a wheeled framework, an engine for powering the vehicle mounted on the framework, a battery carried by the framework and a tank for containing natural gas carried by the framework, the tank comprising an outer vessel, an inner vessel disposed within the outer vessel, support means disposed within the outer vessel for supporting the inner vessel within the outer vessel so that the wall of the inner vessel is spaced apart from the wall of the outer vessel and to provide a space therebetween, means for evacuating the space between the outer vessel and the inner vessel, the inner vessel having a bottom wall lying in a generally horizontal plane, a heater well disposed in the inner vessel in close proximity to the bottom wall of the inner vessel and being surrounded by liquid natural gas, a heating element, means removably mounting the heating element so that it is disposed in the heater well and means for supplying electrical energy to the heater element from the battery to maintain a substantially constant vapor pressure in the inner vessel so that a vapor of natural gas can be supplied to the engine of the motor vehicle at a substantially constant pressure regardless of the requirements of the engine of the motor vehicle.

6. A motor vehicle as in claim 5 together with means carried by the framework for heating the natural gas vapor after it leaves the inner vessel of the tank.

* * * * *